United States Patent [19]

Depew

[11] Patent Number: 4,715,294

[45] Date of Patent: Dec. 29, 1987

[54] PALLET CONSTRUCTION

[76] Inventor: Thomas N. Depew, 10 Sunningdale Dr., St. Louis, Mo. 63124

[21] Appl. No.: 938,169

[22] PCT Filed: Oct. 20, 1986

[86] PCT No.: PCT/US86/02208

§ 371 Date: Oct. 20, 1986

§ 102(e) Date: Oct. 20, 1986

[51] Int. Cl.[4] ..... B65D 19/18

[52] U.S. Cl. ..... 108/51.1; 108/57.1

[58] Field of Search ..... 108/51.1, 57.1; 206/386

[56] References Cited

U.S. PATENT DOCUMENTS

| | | | |
|---|---|---|---|
| 2,395,982 | 3/1946 | White | 108/57.1 |
| 2,651,486 | 9/1953 | Woodward | 108/57.1 |
| 2,817,485 | 12/1957 | White et al. | 108/57.1 |
| 2,823,883 | 2/1958 | Bourdon | 108/57.1 |
| 2,919,090 | 12/1959 | De Pew | 108/57.1 |
| 2,967,036 | 1/1961 | Phillips | 108/57.1 |
| 3,118,400 | 1/1964 | Kemp, Jr. et al. | 108/57.1 |
| 3,645,215 | 2/1972 | Kirkpatrick | 108/51.1 |
| 4,292,899 | 10/1981 | Steffen | 108/51.1 |

*Primary Examiner*—Peter A. Aschenbrenner

*Attorney, Agent, or Firm*—Kalish & Gilster

[57] ABSTRACT

A pallet construction incorporating protective members fabricated of metal, plastic, or other impact resistant material for engaging end portions of the pallet to shield against damage. The protective members comprehend cap portions for embracing stringer end portions, blocks, or other deck supporting components, with said caps being secured to the embraced portions beneath the deckboards. Flanges may be provided upon caps at the end of said protective members for direct securement to the upper surface of the deckboards as well as, optionally, to the under surface of the underlying portion of the pallet. With pallets of block type construction, side protective members may be included to cooperate with the end protective members for reinforcement throughout the entire periphery of the pallet.

25 Claims, 18 Drawing Figures

FIG. 1
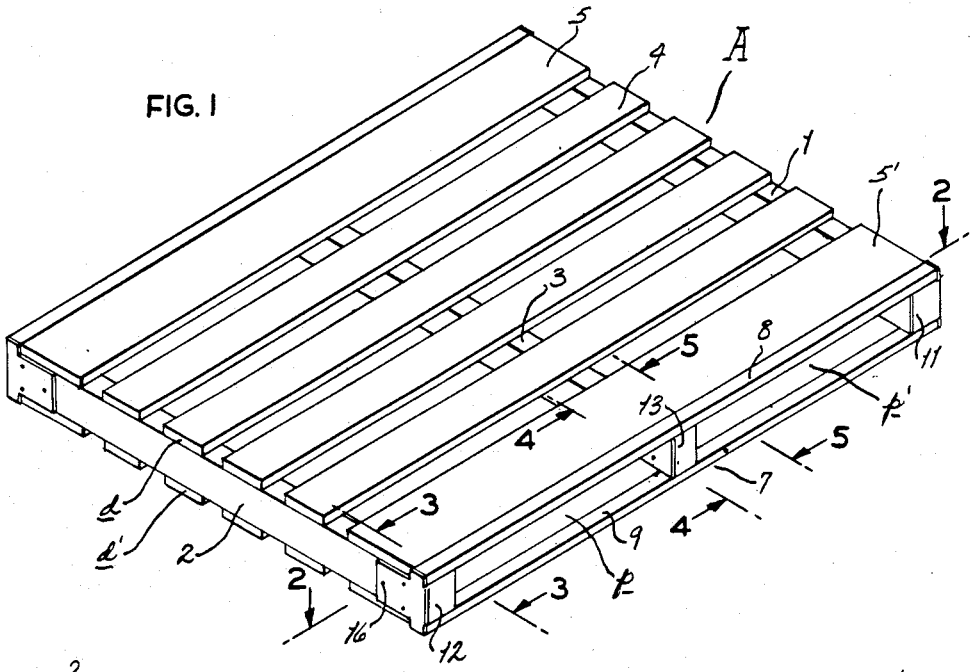
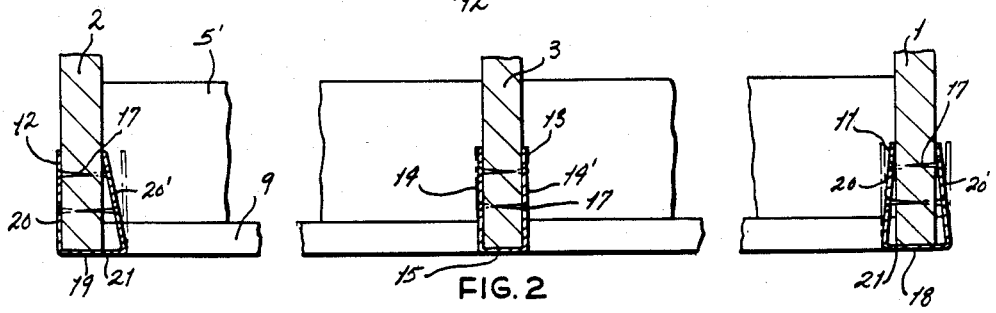
FIG. 2
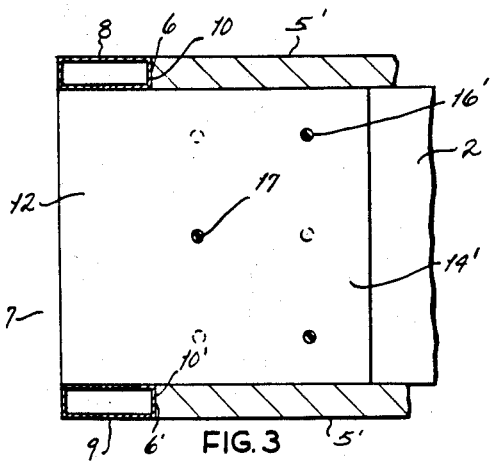
FIG. 3
FIG. 4
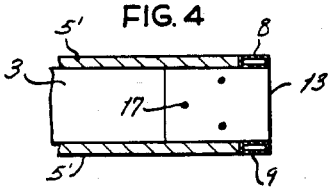
FIG. 5
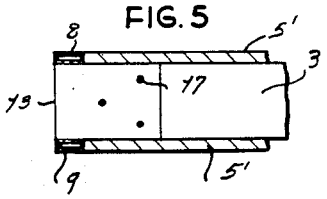

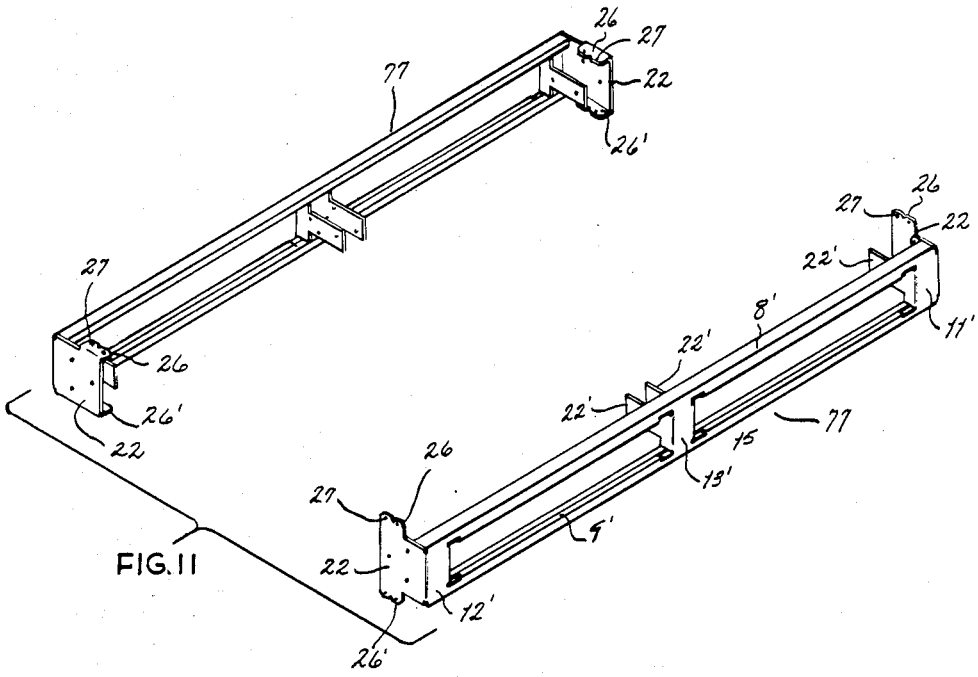
FIG. 11
FIG. 12
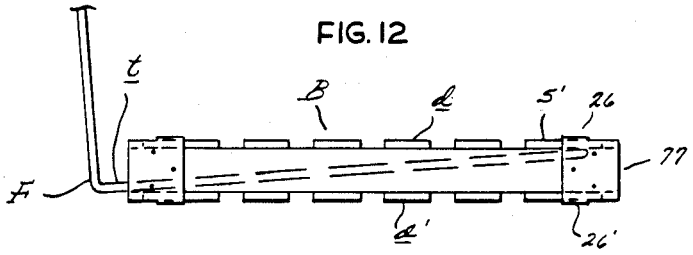
FIG. 13
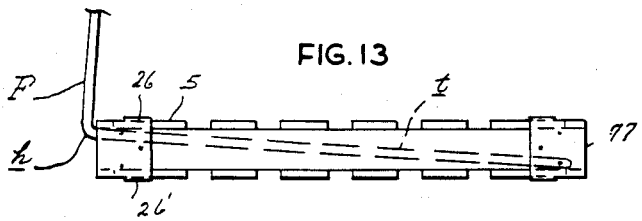

PALLET CONSTRUCTION

BACKGROUND AND SUMMARY OF THE INVENTION

This invention relates in general to industrial pallets of the type embodying spaced-apart decks and, more particularly, to such pallets incorporating novel protective components for conducing to the longevity of usage of the same.

Through the years the cost of maintaining industrial or loading pallets has been of a continuing concern to commercial users due to the ever-increasing price of materials of construction such as, especially, wood or other like rigid, impact-resistant materials, such as, suitable plastics, as well as the persistent rise in labor costs. This is singularly pertinent to pallets of the type comprising upper and lower decks of a plurality of spaced deckboards, with such decks being maintained spacedly by means of stringers which coordinate with the deckboards to present longitudinally extending openings for reception of the tines of forks of a fork-lift truck.

It has been common experience that pallet damage is occasioned for a multiplicity of reasons, including careless handling by personnel and inexpert operation of fork-lift trucks, such as, for instance, by the slamming of the fork heels or adjacent portions of such forks into the end deckboards in the initial addressing of the truck to the pallet which impact results in fracturing or rupturing of the end deckboards, and the ends of the adjacent stringers. Another source of damage is the presentation of the tines at an improper angle to the pallet so that in one position the heel will be elevated with relation to the toe of the tines whereby an undue lifting force is applied against the proximate end deckboards with the upward prying of the same or loosening of the related fasteners; and in the opposite position wherein the heel will be depressed with respect to the tine toes which latter will then effect an upward, driving force upon the truck-remote end deckboards with similar results namely, the fracturing and/or upward prying of such deckboards together with dislogdment of the fastening elements. In addition, improper handling of the fork lift trucks in bringing about appropriate disposition of the tines will quite frequently occasion inadvertent, but strong contact of the forks upon the end portions of the stringers causing the same to crack or be undesirably distorted from initial disposition. Such undesired forcing of the stringers from the appropriate, original position may also be effected by the toe portions of the tines striking the side face portions of the stringers when the forks are used for swinging a pallet into requisite position for accepting the tines. Thus, as suggested by the foregoing, loading pallets of the type hereunder consideration are subjected to destructive forces from numerous sources during customary usage in plants today which, understandably, materially reduce the effective life of the same, at substantial expense.

In view of this situation, pallet users must, with undesired regularity, replace damaged pallets or cause the same to be repaired which is a time consuming and costly procedure. Therefore, The maintenance of pallets in fully reliable, useful condition is an aim which has long beset industry, but which currently is becoming more and more a factor of considerable financial concern in view of rising material and labor costs.

Heretofore, various efforts have been undertaken to protect pallets in order to increase the useful life thereof and, hence, to reduce the necessity of costly repair and/or replacement. Such expedients have essentially consisted of applying directly to portions of the pallet reinforcing members, such as, or angle iron, bar stock, or the like, or substituting the usual material of construction, wood, for deckboards and/or stringers, such as, by utilization of metal. Reinforcing members of the type attempted for shielding usage were immediately secured to the peripheral edge portions of the pallet, such as along the transverse, as well as longitudinal, edges of the deckboards and on the end surfaces of the stringers. In essence, these members constituted what might be considered armor plating or were at least edge bindings. Extensive destructive tests were conducted to determine the efficacy of such reinforcing members and the results were quite disappointing in that such tests proved beyond any doubt that pallets so equipped were but slightly more resistant to damage than those pallets not so provided. There had been insufficient appreciation of the precise areas of incidence of destructive forces acting on the pallets during normal usage in order to apply any such reinforcing members in a counter-destructive manner. Actually, such armor elements being attached to portions of the pallet caused a direct transmission of the force of the blows received to the wooden portions of the pallet so that damage was not effectively prevented.

Another expedient has been the substituting of metallic stringers for the customary wooden stringers but such did not solve the basic problem as the utilization of such stringers did not in any way protect the pallet in its most vulnerable point namely, the end deckboards.

All such previous contrivances were provided to increase substantially the cost of the pallets which was not justified as pointed out. Additionally, such prior efforts were not concerned with the economic facilitation of repair of damaged pallets.

Therefore, it is an object of the present invention to provide a pallet construction incorporating novel protective components adapted to resist damage to the end deckboards and the stringers, as might normally heretofore have been occasioned a pallet through improper or negligent fork-lift truck operation and/or careless plant handling, whereby the pallet will remain in a fully utilitarian condition for time periods markedly exceeding the useful life of presently available pallets.

It is another object of the present invention to provide a pallet construction as described wherein the protective components are uniquely constructed so as to embody portions which provide a reliable damage-resistance to undesired elevating or upward prying forces acting upon the end deckboards so as to inhibit fracturing thereof and/or loosening of the associated fasteners.

It is another object of the present invention to provide a pallet construction of the type hereinabove stated wherein the protective members embody constituents which provide extended lateral support to the end portions of the stringers so as to cause same to withstand forces which would normally tend to urge same from initial relationship with the deckboards.

It is a still further object of the present invention to provide a pallet construction of the type stated wherein the protective members include adjustable portions for assuring of effective embracing of the end portions of the end deckboards within the normal range of fluctuations of the thickness thereof.

It is a further object of the present invention to provide a pallet construction of the character stated wherein the protective members may be uniquely dimensioned for efficiently accommodating stringers which may have been distorted from an original position through careless handling and thereby conduce to great economy by virtue of obviating the necessity of replacing the stringers with the occasioned substantial reconstruction of the pallet.

A still further object of the present invention is to provide a pallet construction wherein the protective components shield the end deckboards against undesired upward ripping from forces applied by steel straps or other banding means for securing loads upon the pallet as well as to guard against fracturing or breaking due to lifting forces effected by cargo slings.

It is another object of the present invention to provide a pallet construction of the character stated wherein the protective components serve to maintain the overall integrity of the pallet.

It is a further object of the present invention to provide a pallet construction of the basic so-called flush block type, also generally referred to as the "European pool pallet", which is peculiarly adapted to resist the destructive impact forces to which the same is customarily subjected in normal usage.

Another object of the present invention is to provide protective members for engagement upon existing flush block-type or European pool pallets for reinforcing the same and thereby conducing to a substantially increased operational life.

It is a further object of the present invention to provide a pallet construction of the character stated which may be economically manufactured; the use of which reduces pallet maintenance cost to a minimum; which pallets may be of various constructions or designs; which pallets may be built of any suitable material of construction which is impact resistant, such as, particularly, wood and various suitable plastics; and which pallets have been proven reliable and durable in usage; as well as to provide discrete pallet protective members for engagement upon existing pallets.

BRIEF DESCRIPTION OF THE DRAWINGS

FIG. 1 is a perspective view of a pallet constructed in accordance with and embodying the present invention showing the protective components in mounted, operative disposition thereof.

FIG. 2 is a fragmentary, horizontal, transverse sectional view taken substantially on the line 2—2 of FIG. 1 but illustrating the outer stringers as having engaged thereon the oversized brackets of a replacement protective member while the center stringer illustrates the associated bracket for original construction.

FIG. 3 is a vertical, transverse sectional view taken on the line 3—3 of FIG. 1.

FIG. 4 is a vertical, transverse sectional view taken on the line 4—4 of FIG. 1.

FIG. 5 is a vertical, transverse sectional view taken on the line 5—5 of FIG. 1.

FIG. 11 is an exploded, perspective view of a further form of a pallet protective component constructed in accordance with and embodying the present invention for disposition upon a pallet of the type illustrated in FIGS. 1 and 6.

FIG. 12 is a side view of a pallet contruction conforming to either of that shown in FIG. 6 or 11 with a fork lift tine (partially in phantom lines) in an improper attitude for applying an elevating force upon the truck-remote pallet end deckboards.

FIG. 13 is a view similar to FIG. 12 but differing therefrom in that the pallet tine is shown in a reverse position wherein the fork heel portion is applying an undesired lifting force upon the truck-proximate pallet end deckboard.

DESCRIPTION OF THE PREFERRED EMBODIMENTS

Figures 6, 7, 8, 9, 10:
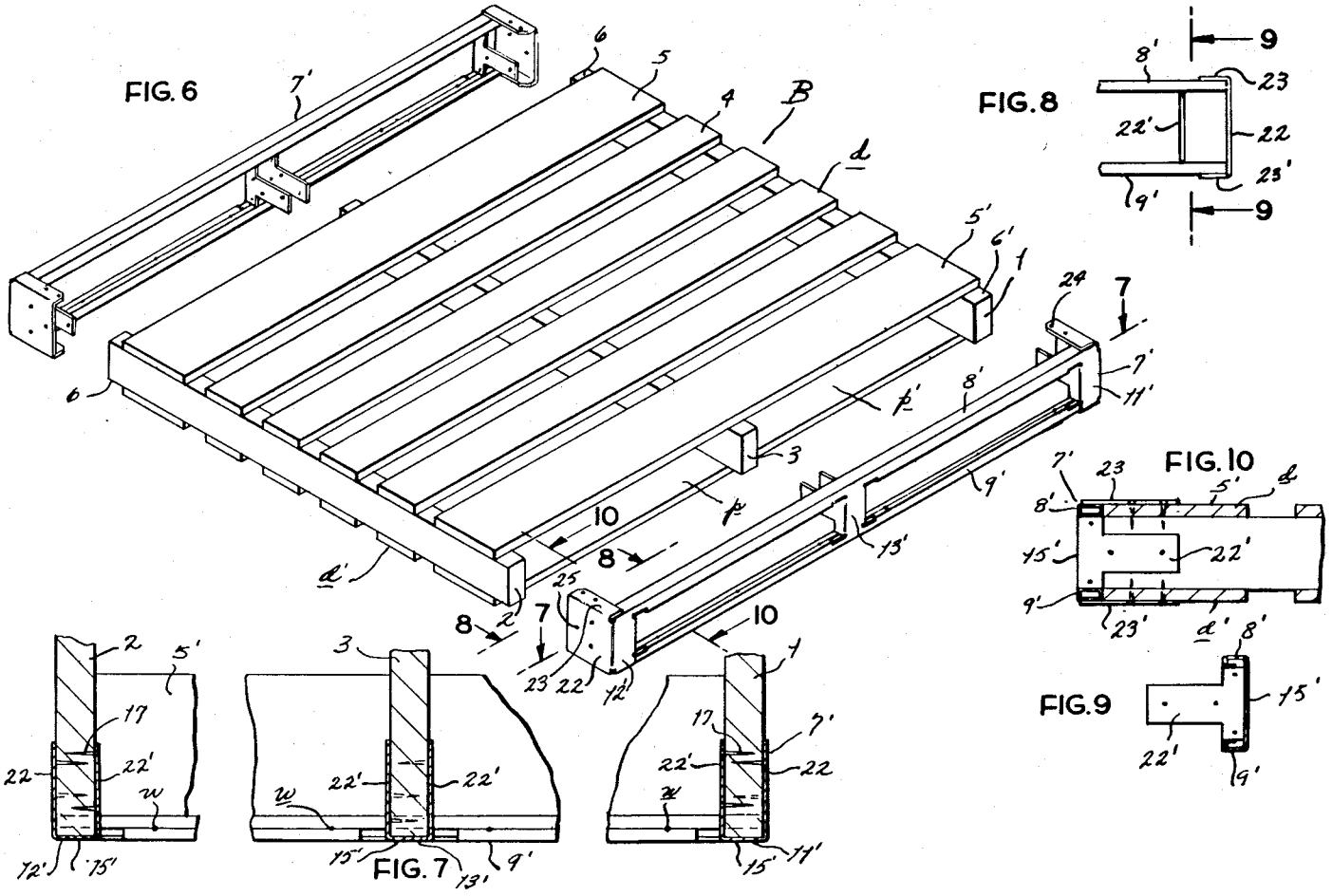
FIG. 6 is a perspective, exploded view of a pallet constructed in accordance with and embodying the present invention, but having a further form of protective component.
FIG. 7 is a fragmentary, horizontal transverse sectional view taken on the line 7—7 of FIG. 6.
FIG. 8 is a fragmentary, vertical view taken on the line 8—8 of FIG. 6.
FIG. 9 is a vertical, transverse sectional view taken on the line 9—9 of FIG. 8.
FIG. 10 is a fragmentary, vertical transverse sectional view taken on the line 10—10, but illustrating the pallet body and the adjacent protective component in engaged relationship.

Referring now by reference characters to the drawings which illustrate the preferred embodiments of the present invention, A designates an industrial loading pallet of generally conventional character, being illustrated, for purposes of exposition, as of the reversible or double-faced, flush-type stringer design incorporating parallel outer stringers 1,2, respectively, and a central stringer 3; there being upper and lower decks d,d', respectively, each being comprised of a plurality of spaced-apart deckboards 4 and end deckboards 5,5', the outer end edges of the latter being spaced from the adjacent ends of stringers 1, 2, 3 to define end spacings indicated at 6,6', respectively. Said deckboards 4, 5,5' are fixedly secured to stringers 1, 2, 3 by nails or other suitable fasteners. It will, accordingly, be seen that upper and lower decks d,d' and stringers 1, 2, 3 cooperate to define the usual side-by-side, lengthwise extending, open-ended passages p,p' for receiving the tines of the fork of a fork-lift truck for facilitating load handling. The components of pallet A are constructed most frequently of wood, but it is understood that the same may be constituted of any durable, wear-resistant, load-supporting material, such as, various plastics, metals, etc.

Provided for mounted disposition at each end of pallet A is a protective member 7 fabricated, preferably, of metal, but may be manufactured of any deformable-resistant plastic or the like. Each protective member 7 comprises upper and lower bars or elongated elements 8,9, respectively, which may be of solid or of rectangular tubular form (as shown in the drawings), being thus of flat-sided configuration. If desired, they may be of rolled form section with a series of welds provided spacedly along the line of opening (not shown). Each bar 8,9 is dimensioned for snug reception within adjacent spacing 6,6', as the case may be, and are dimensioned so that the respective upper and lower surfaces thereof are substantially flush with the adjacent end deckboard 5,5', and with the outer end surfaces thereof substantially flush with the end faces of the adjacent stringers. The inner ends of each bar 8,9 are in snug abutting relationship with the confronting end edge of the proximate end deckboard 5,5', as indicated at 10,10', respectively.

Said bars 8,9 are rigidly secured, as by welding, to outer stringer end caps or brakcets 11,12, and a central stringer end cap or bracket 13, for embracingly receiving the end portions of outer stringers 1,2 and central stringer 3, respectively. Each such stringer end cap is of generally U-shape in cross-section embodying a pair of arms or wings 14,14' interconnected at their normally outer ends by a web 15. As constituting original components of pallet A, stringer end caps are dimensioned for snug reception of the adjacent end portion of the related stringer so that the inner face of web 15 is of a transverse extent substantially equivalent to that of the associated stringer whereby the inner face of each web 15 abuts against the end face of each such stringer and the related arms or wings 14 are in tight contact with the confronting lateral face portions of the particular stringer 1,2,3, as the case may be, and all as may be seen more particularly in the central portion of FIG. 2. Each arm or wing 14,14' is provided with a plurality of staggered openings, as indicated at 16,16', respectively, with the openings 16 being offset with relationship to the openings 16' so that the fasteners, such as, nails, 17 extending therethrough for securement of the particular end cap or bracket 11, 12, 13, are in non-interferring disposition. It is, of course, recognized that any suitable fastener may be used, such as, screws, rivets, as well as nails and the like.

It is to be especially noted that the arms or wings 14,14' are of such height as to extend substantially from the inner face of upper deck d to the upper face of lower deck d', and with the length thereof being sufficiently great so as to project a substantial distance inwardly of pallet A beneath the proximate end deckboards 5,5' of the upper and lower decks d,d'. Thus, said arms or wings 14,14' are of predetermined length for assuring of a relatively large area of contiguity with the engaged stringer for assuring of displacement-resistant anchoring of protective members 7 in operative position, as well as for providing a reinforcing, armor-like plate for accepting the direct impact of the tines of a fork of a fork-lift truck when the latter are utilized for slewing pallet A, thereby preventing stringer fracturing.

From the foregoing, it will thus be seen that protective members 7 reliably serve to prevent costly damage to pallet A through careless handling or improper fork lift truck manipulation. Protective members 7 are of such rigid construction as to permit minimal transmission of any received impact forces to the adjacent portions of the deckboards and/or stringers so that the latter remain materially proof against fracturing, fastener loosening and the like. The length of arms or wings 14,14' are of such extent as to effect a substantial dissipation of forces accepted through improper pallet handling as well as to inhibit any inadvertent dislodgement of said protective member 7 thereby producing relatively increased longevity of pallets A and, hence, reducing the heretofore frequent need to replace components of the pallet by virtue of damage from inept handling.

The foregoing thus describes protective members 7 as the same are produced for mounting upon new pallets A. However, protective members 7 may be designed for replacement purposes since after the incidence of damaging forces over a long period of time there may be occasioned some distortion or deformation of the stringers. Thus, protective members conforming in all respects to those hereinabove described at 7 may be produced, but wherein the stringer end caps or brackets may be oversized with respct to the related stringer end to provide inherently an accommodating adjustability.

Reference is now made to the lateral portions of FIG. 2 wherein, for purposes of exposition, 18,19 designate outer stringer end caps or brackets of a replacement protective member which correspond to the end caps or brackets 11,12 above described and which are similarly of U-shaped cross-section having arms or wings 20,20' and an interconnecting web 21. It will be seen that the transverse extent of said caps 18,19 is greater than the thickness of the related stringer 1,2, as the case may be. At this point, it may be appropriate to indicate that with replacement protective members incorporating caps 18,19, a central cap is, of course, also provided and which may be of the same dimensions as the original cap 13 since normally the stringer distortion occurs most frequently in the outer stringers but, understandably, the central cap may be also of oversized cross-section as caps 18,19 for accommodating distorted central stringers 13. Thus, at the right hand side of FIG. 2, stringer 1 is in substantially original disposition so that its outer end face will abut the central portion of the inner face of web 21. To effect securement, both arms 20,20' will be driven inwardly toward the adjacent side of stringer 1 and held by the particular fasteners 17.

However, turning now to the left hand side of FIG. 1, it will be seen that the particular stringer being accepted, as shown at 2, has been outwardly, laterally displaced from original construction. Thus, arm 20 of cap 19 will snugly abut against the outer face of such stringer 2 and with web 21 in its outer portion abutting the end face of said stringer. To effect securement, inner arm or wing 20' must be driven, as by a suitable tool, inwardly toward stringer 2 and being held by the related fasteners 17.

Thus, end caps 18,19 merely illustrate an after-market construction designed to assure of positive engagement of the related stringer regardless of the movement of the same from original disposition. Whether the same be driven inwardly or outwardly is not a matter of concern since the oversized character of such end caps as illustrated at 18,19 will readily accommodate any such deformation as may have occurred. With stringer end caps of this last-described character, there is manifestly no need of affecting the construction of the associated bars 8,9 or of their relationship to the accompanying end caps.

Referring now to FIGS. 6–10, inclusive, another form of pallet construction embodying the present invention is illustrated and designated generally B. It is to be understood that components of pallet B corresponding structurally to components of pallet A above-described will bear the same reference characters.

Pallet B, for purposes of description, is shown as being of the reversible or double faced, flush-type stringer design incorporating outer stringers 1,2, respectively, a central stringer 3, upper and lower decks d,d', respectively; each of the latter being comprised of a plurality of spaced-apart deckboards 4 and end deckboards 5,5', the outer end edges of the latter being spaced from the adjacent ends of the stringers 1,2,3 to define a spacing at 6,6', respectively, and with said deckboards and stringers being arranged to define tine-receiving passages p,p' on either side of central stringer 3.

Provided for mounted disposition at each end of pallet B is a protective member 7' each of which embodies upper and lower bars or elongated elements 8',9' and outer stringer end caps or brackets 11',12' and a central stringer end cap or bracket 13'.

Protective members 7' are shown as being formed as by stamping, and with the associated bars 8',9' being rolled into generally tubular flat-sided configuration, with there being a series of spot welds, as at w, throughout the line of jointure for rigidification purposes; said bars 8,9 being dimensioned for snug reception within the spacings 6,6'. Thus, with this manner of manufacture, the stringer end caps or brackets 11', 12', 13' are formed through appropriate operation from the original sheet material. It is to be understood, however, that the discussion of protective members 7' being produced pursuant to stamping procedures is not in any way intended to limit the nature of the same since it is quite obvious that said protective members could be manufactured from preformed components integrated by welding, or of extruded or molded material, as suggested by the construction of protective member 7 above described in conjunction with pallet A.

Each stringer end cap or bracket is of general U-shape in cross-section, with outer end stringers 11',12' each having outer and inner arms 22,22', respectively, while central stringer end cap or bracket 13' is provided with a pair of arms which are of like configuration as inner arms 22' of stringer end caps 11',12' and are, thus, designated with the same reference numeral, namely 22'. The arms of each of such stringer end caps or brackets 11', 12', 13' are interconnected in their forward end portions by a web 15. It will be seen that end caps or brackets 11', 12', 13' relate, and are secured, to the associated stringer in the same manner as those described hereinabove with pallet A. The bracket arms indicated 22' are of relatively reduced height with respect to the adjacent stringer (see FIGS. 9 and 10), with the extent and configuration thereof being determined by the stamping procedure. However, outer arms 22 of each of the caps 11', 12' are of a height which is equivalent to the combined height of the adjacent stringer and upper and lower deckboards (see FIG. 10), and with their being at the upper and lower ends of each such arms 22 inwardly turned flanges 23,23' which are preferably of like length as the related arm 22 and being of such transverse dimension as to abut on the inwardly directed surfaces thereof the proximate portion of the adjacent face of upper or lower deckboard. Each of said flanges 23,23' is provided with a plurality of openings 24 for extension therethrough of fastener elements, such as nails and the like, so as to reliably affix said flanges 23,23' to the adjacent deckboard and stringer (see FIG. 10). It is, of course, evident that openings 24 are located so that the securing elements extending therethrough will not interfere with like elements projecting through the openings 25 formed in the arms of the associated end cap or bracket.

With the above-described construction of pallet B embodying protective members 7', it is to be especially noted that the latter, in addition to providing the pallet-shielding properties as discussed hereinabove with respect to protective member 7, provide a further critical protective feature by virtue of flanges 23,23'. The latter serve to uniquely and securely sandwich the interposed portions of pallet B to thereby enhance materially the integrity of pallet B, as well as to constitute zones of increased resistance to any untoward or improperly applied prying force exerted upon the engaged end deckboards. This condition is more graphically presented in FIGS. 12 and 13, as will be described more fully hereinbelow in jointly considering the further modification as shown in FIG. 11.

Turning now to FIG. 11, a further form of protective member 77 is shown which, in a fundamental sens, functionwise and structurally, corresponds to protective member 7' above described so that like components will bear like reference numerals. It is to be understood that protective member 77 is equally useful with pallets A and B above described in lieu of protective members 7,7'.

Protective member 77 differs from protective member 7' only with respect to the nature of the upper and lower flanges 26,26' formed on outer arms 22 in lieu of upper and lower flanges 23,23', respectively, as shown in conjunction with protective member 7'. Said flanges 26,26' are originally in planar coincident relation to the associted arm 22 (see FIG. 11). Such flanges 26,26' are of less length than the related arm 22 so as to be conducive to bendability substantially about a line coincident with the adjacent edge of the related arm 22 whereby said flanges 26,26' may be turned inwardly at a requisite angle to be brought into snug abutment against the proximate deckboard and being securable thereto by fastener elements projecting through openings 27 provided in such flanges. Thus, flanges 26,26' serve the same purpose as flanges 23,23' above-described by markedly conducing to the integrity of the related pallet and particularly in providing a yield-resistance to the engaged deckboard for reinforcing same against fracturing or loosening by improperly applied forces as discussed hereinbelow in connection with FIGS. 12 and 13.

Thus, flanges 26,26', by reason of their bendability, will serve to accommodate pallets wherein the thickness of the upper and/or lower deckboards may be slightly greater or less than usual so that a tight sandwiching is assured.

With reference now being made to FIG. 12 it will be observed that the tines t of the fork F of a fork lift truck are projected into the passages p,p' of the particular pallet at an angle to the horizontal wherein the distal end of tine is elevated with respect to the fork heel. In this undesired attitude, the tine will cause an elevating force upon the under face of the end deckboard 5' of the upper deck d which will manifestly tend to push such end deckboard upwardly with a consequent loosening of the related fastener elements with either fracturing or partial displacement of such end deckboard. It will be observed that in this condition such end deckboard is taking substantially the entirety of the lifting force of the fork, whereas more properly the fork should underlie all of the deckboards of the upper deck and thereby diffuse the lifting force. Accordingly, upper flanges 26 serve to render such end deckboard 5' resistant to the undesired effects of such improper force application and thereby conduce to the longevity of pallet B.

FIG. 13 illustrates the fork tines t being in an attitude opposite to that shown in FIG. 12 wherein the distal end of the tines is lower than the fork heel h. In this state, fork heel h will exert an upward prying action upon the proximal end deckboard 5 and with resistance of the latter being markedly enhanced by flanges 23,23'. The disposition of the fork tines t shown in FIGS. 12 and 13 is regrettably a very common occurrence in industry and being demonstrative of an inexpert, or negligent, operation of the fork lift truck.

In passing, it is to be observed that although FIGS. 12 and 13 illustrate protective members 77 embodying flanges 26,26', the same are fully illustrative of the functioning of flanges 23,23' of protective members 7' above described.

Although the protective members 7' and 77 have been described as being mounted upon original equipment, that is, newly manufactured pallets, it is to be understood that the end caps of each may be, if desired, oversized as described hereinabove with repsect to a replacement protective member 7, and as more fully illustrated in FIG. 2 at 18,19. Therefore, the protective members of the present invention are equally adaptable for new equipment, or for repair or replacement purposes.

Also, it is of singular noteworthiness that although pallets A and B have been shown as of the reversible or double faced, flush-type stringer design, the same could be constructed as a conventional, single faced, flush stringer design without departing from the character of this invention and, similarly, a so-called "flush block-type" pallet would be equally suitable for receiving protective members constructed in accordance with the present invention.

Referring now to FIGS. 14–18, inclusive, C designates a pallet construction of so-called flush block, or European pool-type, comprising an upper deck e comprised of a plurality of axially parallel, transversely extending deckboards 30 which are fixedly secured, as by suitable fasteners, upon a pair of outer stringer plates 31,31', and a central stringer plate 32; said latter being planarwise parallel to the overlying deckboards 30 and being of comparable thickness. Said deckboards 30 are preferably flush at their end edges with the proximate side edge of the adjacent outer stringer 31,31', as the case may be, and with the deckboards at each end, as at 30',30'', being spaced inwardly from the outer ends of the underlying stringer plates to create a spacing, as at s, of predetermined linear extent and for purposes presently appearing.

Each other plate 31,31' is mounted at each end thereof upon discrete end blocks 33 which thus constitute corner blocks for pallet C. Center stringer plate 32 is mounted at the ends thereof upon central blocks 34 which are thus axially aligned with proximate end blocks 33. Each block 33 at the corner of pallet C on its outermost edge is desirably bevelled, as at 35, for obviating damage by inadvertent usage which would occur without such bevelling. Outer stringer plates 31,31' are also each engaged substantially intermediate their length upon a center block 36 which are mutually axially aligned with a block 34' engaged to center stringer plate 32 between blocks 34. Thus, blocks 36 and 34' cooperate with the above-described blocks at the ends of pallet C to provide suitable under bracing for deck e and the load received thereon.

To promote the integrity of the construction of pallet C, blocks 33 at each end of pallet C, together with the intervening block 34, are interconnected on their under surface by an elongated element 37, the outer edge of which is spaced inwardly from the outer end faces of the associated blocks 33,34, as at w, and with such end edges being bevelled or upwardly and inwardly inclined, as at v, for purposes presently appearing.

Center blocks 36 and the intervening block 34' are also interconnected on their under surfaces by an elongated member 38 thus conducing to the sturdiness of pallet C.

In view of the foregoing, it is thus apparent that pallet C is of the single deck-type so that only deck e is intended to receive the particular load.

Provided for disposition upon each end of pallet C is a protective member indicated generally at 39; it being recognized that said members are of like construction so that for sake of brevity only one such member will be described, but with the recognition that such is of equal applicability to both such members.

Protective member 39 is fabricated of suitable metal, plastic, or other impact resistant material for protecting pallet C against damage as would normally occur through negligent, irresponsible, or inept fork-lift truck operation, or by general handing within a plant. Protective members 39 are of the general character of protective members 7,7' hereinabove described, but are peculiary adapted for utilization with pallets of the flush block type. Protective members 39 are preferably of stamped metal construction for purposes of economy and comprise end block caps or brackets 40,40' and a central block cap or bracket 41, being interconnected by upper and lower elongated components 42,43, respectively of flat-sided tubular generally rectangular configuration. End block caps 40,40' are each of general U-shape configuration in cross-section, having an outer side wall 44, an inner side wall 45, and an interconnecting web 46 at the outer end of the associated side walls; said web 46 upon the inner surface thereof being adapted to abut against the outer end face of the related end block. The zone of jointure between each web 46 and the related outer side wall 44 is bevelled, as at 47, for accommodating the related bevel 35 of the particular received end block 33. Thus, outer side walls 44 of each of said block caps 40,40' will abut against the outer side wall, as at 48, of the associated end block 33 and similarly the inner side walls 45 will lie flush against the inner side walls 49 of such end blocks 33. Outer side walls 44 are provided with staggered openings, as at 50, for extension therethrough of suitable fasteners, such as nails, for securement of the end caps to the accepted block 33, and at the inner end of the upper edge of each side wall 44 there is provided a pair of inwardly turned finger-like flanges 51,51' for disposition upon the confronting portion of the upper surface of the proximate end deckboard 30',30'', as the case may be. Each such flange 51,51' is provided with an opening 52,52' for extension therethrough of a fastener, as nails, screws or the like, to secure the related end cap to such deckboard. A similar pair of finger-like flanges 53,53' are formed on the lower edge of each end cap side wall 44 which are in vertical alignment with the overlying flanges 51,51', respectively. Said last mentioned lower flanges 53,53' are located so as to underlie the confronting portion of the under surface of element 37 for engagement thereto as by nails or the like. It will thus be seen that flanges 51,51', 53,53' are spacedly disposed from web 46 of the associated block end cap 40,40' for suitable disposition to engage the related deckboard and elongated element, both of which, as pointed out, are spaced from the end faces of the adjacent blocks. It is, of course, apparent that flanges 51,51', 53,53' are presented a sufficient distance above and below the adjacent edge portion of the respective side wall 44 of end caps 40,40' so that the elongated element 37, as well as the end deckboard and adjacent stringer plate are comprehensively embraced (see FIG. 16).

The inner side walls 45 of block end caps 40,40' are of a length corresponding to that of the accepted block 33 so that appropriate lateral support is provided for the pertinent block; with there, of course, being openings 54 for the preselected fastener.

Central cap or bracket 41 is also of U-shaped cross-section having a pair of parallel side walls 55 which are interconnected by a web 56 at their outer ends, with such web 56 and side walls 55 being dimensioned for snug reception of the proximate block 34.

Upper and lower elongated components 42,43 between each end block cap 40,40' and the intermediate cap 41 is contoured into general tubular form in cross-section (see FIG. 15) and of such transverse extent as to fill the associated spacing s, and with upper and lower surfaces respectively thereof being flush with the adjacent deckboard and elongated element, respectively. The forwardly directed surfaces of said members 42,43 are of rounded configuration in the corners thereof, as at 57, for promoting resiliency so that the initial configuration is retained after a temporary yielding to inadvertent impact with a component of a fork-lift truck. Similarly, the rearward portions of such components 42,43 are rounded, as at 58, to promote the resilient character of such members.

Figures 14, 15, 16, 17, 18:
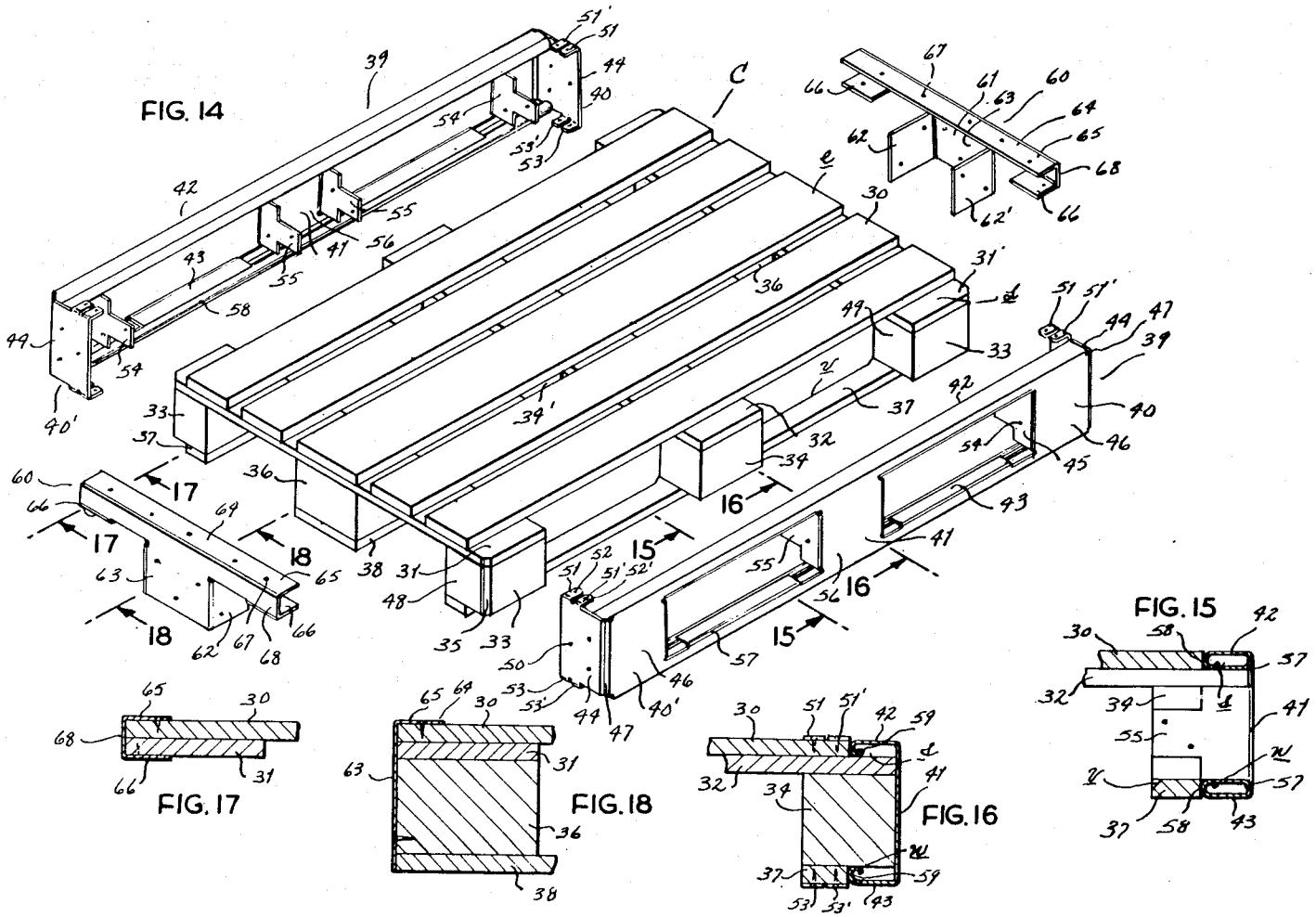
FIG. 14 is an exploded perspective view of a pallet of the so-called flush block or European pool-type incorporating protective members constructed in accordance with and embodying the present invention.
FIG. 15 is a fragmentary transverse vertical sectional view taken substantially on the line 15—15 of FIG. 14 illustrating the depicted portion of the end protective member in operative condition.
FIG. 16 is a fragmentary vertical transverse sectional view taken substantially on the line 16—16 of FIG. 14 illustrating the depicted portion of the end protective member in operative condition.
FIG. 17 is a vertical transverse sectional view taken substantially on the line 17—17 of FIG. 14 but illustrating the depicted portion of the protective side member in operative condition.
FIG. 18 is a vrtical transverse sectional view taken on the line 18—18 of FIG. 14 illustrating the depicted portion of the protective side member in operative condition.

As may best be seen in FIG. 16, said upper and lower components 42,43 immediately proximate and aligned with end blocks 40,40' and intermediate block 41 do not, understandably, form a completed tube, but are of curvate character at the inner ends thereof, as at 59, for enhancing resiliency as described.

Thus, end protective members 39 securely embrace the respective end portions of pallet C so that appropriate reinforcement is directly applied to the associated blocks and indirectly to the entire pallet construction. The finger-like flanges 51,51', 53,53' sandwichingly engage the adjacent portions of the pallet component so as to promote the integration of the same, as well as to inhibit damage as through prying or the like, as might be occasioned by presenting the tines of a fork-lift truck at an inappropriate angle. Furthermore, it will be seen that the side walls of each block cap extend the full length of the adjacent side wall of the proximate block to give full lateral support thereto and, thus, enhance the unity of pallet C despite the quality of usage.

From the foregoing it is indeed obvious that protective members 39 could be applied to existing flush block-type pallets with extremely limited modification of the latter so that said members are useful both with new construction or reconstructed, damaged pallets, as well as with existing pallets which would require but limited and easily effected modification.

Pallet C is also equipped with a protective member 60 on each side thereof, which members are of like configuration and construction so that the description will be restricted to but one of the same for purposes of brevity. Each said protective member 60 incorporates a block cap 61, of general U-shape, having parallel side walls 62,62', and an interconnecting web 63 at the outer ends thereof. Said caps 61 are dimensioned and adapted to snugly receive the proximate center block 36 whereby side walls 62,62' will abut against the confronting side wall of the related block 36, such cap side walls being of height adequate to cover the adjacent portion of the elongated plate member 38. Web 63 is of relatively increased height, being equal to the overall height of block 36, underlying plate 38, overlying stringer plate 31 (or 31' as the case may be), and the superimposed deckboard 30, with the upper edge of said web 63 being integral with the central portion of an elongated channel member 64 which extends from each side of cap 61 a distance corresponding to that between block 36 and the adjacent end blocks 33. Said channel member 64 is provided with an upper, inwardly turned flange 65 for overlying relationship upon the proximate portion of the adjacent deckboards and with there being a lower, inwardly turned, parallel flange 66 for abutting on its upper surface the under face of the adjacent stringer plate 31. Said flanges 65,66 are securable to the respective deckboards and stringer plate as by predetermined fasteners projecting through openings, as indicated generally at 67. Flanges 65,66 of each side protective member 60 are interconnected by a vertical web 68 of an extent adequate to assure snug embracing of the received portions of the deckboards and stringer plate.

Accordingly, it will be seen that side protective members 60 cooperate with protective members 39 so as to entirely shield the periphery of pallet C and, thus, guard the entirety of the structure against inadvertent, costly damage from negligent fork-lift truck operations or plant handling.

It will be appreciated that such an all-surrounding protective system is indicated with this type of construction since the latter provides for pallet fork tine entry along the ends, as well as the sides, as contradistinguished from pallets of the type discussed hereinabove as designated A, B, wherein the outer stringers are continuous and, thus, prevent entry from the sides.

Therefore, the foregoing discloses pallet constructions which are uniquely contrived to be rendered damage-resistant to the various pallet-destructive forces applied through customary pallet handling in industrial plants, whether the same result from the irresponsible fork-lift truck operation, or workmen handling in storing and transporting, or by reason of load strapping operations. Additionally, such novel pallet constructions as herein disclosed are suitable for what may be termed "after-market" purposes so as to accommodate pallets with distorted or out-of-place components resulting from hard usage and thereby ehhance the life of such pallet without resort to costly, substantial reconstruction of the same.

What is claimed is:

1. A pallet comprising spaced-apart stringers, a plurality of deckboards secured to upper and lower edges of said stringers in axial transverse relation thereto to define upper and lower decks, at least one end deckboard of each deck being spaced inwardly from the adjacent ends of the stringers to form end spacings, a protective device provided at said at least one end of said pallet comprising a plurality of stringer end caps for engagingly receiving the projecting end of the related stringer and being of general U-shape in cross-section, said end caps each having a pair of arms for disposition against the proximate side face portions of the related stringer and an interconnecting web for abutment on the inner face thereof against the confronting end face of such stringer, said arms being of such dimension lengthwise of the pallet as to project a substantial distance between the adjacent deckboards of the upper and lower decks, means for securing said arms to the proximate stringer in the zones thereof between said upper and lower decks, upper and lower rigid elongated members in axial parallel relation to said deckboards, the upper and lower elongated members each being of flat-sided tubular configuration and fixedly secured upon the upper edges of said stringer end caps for fitted reception within the end spacings for snug abutment of said elongated members against the proximate end face of the adjacent deckboard and against the adjacent edge of the stringers, said elongated members being of such transverse dimension as to be flush with the webs of the engaged stringers.

2. A pallet as defined in claim 1 and further characterized by the end deckboard of each deck being spaced inwardly from the adjacent ends of the stringers to form end spacings.

3. A pallet as defined in claim 1 wherein the arms of said end caps are of a height substantially equivalent to the distance between the upper and lower deckboards so that the upper and lower edges of said arms are in substantial contiguity with the immediately adjacent deckboard.

4. A pallet as claimed in claim 1 wherein the arms of each end cap are of less height than the distance between the upper and lower deckboards and being located substantially intermediate such intervening distance.

5. A pallet as defined in claim 1 wherein the end cap arms extend lengthwise of the pallet a distance at least substantially equivalent to one-half the transverse extent of the proximate upper and lower end deckboards of the upper and lower decks.

6. A pallet as defined in claim 1 wherein the elongated members are of rectangular tubular construction.

7. A pallet as defined in claim 1 wherein the protective members are constructed of durable impact-resistant material.

8. A pallet as defined in claim 7 wherein the material of the protective members is metal.

9. A pallet as defined in claim 7 wherein the material of the protective members is plastic.

10. A pallet comprising spaced-apart stringers, a plurality of deckboards secured to upper and lower edges of said stringers in axial transverse relation thereto to define upper and lower decks, at least one end deckboard of each deck being spaced inwardly from the adjacent ends of the stringers to form end spacings, a protective device provided at said at least one end of said pallet comprising a plurality of stringer end caps for engagingly receiving the projecting end of the related stringer and being of general U-shape in cross-section, said end caps each having a pair of arms for disposition against the proximate side face portions of the related stringer and an interconnecting web for abutment on the inner face thereof against the confronting end face of such stringer, said arms being of an extent to project between the adjacent deckboards of the upper and lower decks, means for securing said arms to the proximate stringer in the zones thereof between said upper and lower decks, upper and lower rigid elongated members in axial parallel relation to said deckboards and being fixedly secured upon the upper edges of said stringer end caps for fitted reception within the end spacings for snug abutment against the proximate end face of the adjacent deckboard and the adjacent edge of the stringers, said elongated members being of such transverse dimenion as to be flush with the webs of the engaged stringers, the inner transverse extent of the web of at least one end cap being of greater transverse extent than that of the related stringer, and the arms of such end cap having such webs being of sufficient bendability about the line of jointure to the related web for facile direction toward the associated stringer side face to assure reliable embracing of the accepted portion of such stringer.

11. A pallet as defined in claim 10 wherein such pallet comprises first and second outer stringers and a central or intermediate stringer, and at least said outer caps are provided with webs of greater transverse extent than the related stringers.

12. A pallet as defined in claim 1 wherein there are provided first and second outer stringers and a second or intermediate stringer, and the end caps for said first and second outer stringers are provided with inner and outer arms of different height, said inner arms being of less height than the distance between the deckboards of the upper and lower decks, and the outer arms being of a height substantially equivalent to the combined height of the adjacent stringer and the upper and lower deckboards.

13. A pallet as defined in claim 12 wherein flanges are provided at the upper and lower ends of each outer arm, said flanges being substantially planarwise normal to the plane of the intervening arm for disposition flatwise against the adjacent surface of the proximate deckboard, and means for securing said flanges to said deckboards.

14. A pallet as defined in claim 13 wherein said flanges are of like length as that of the intervening arm and are in predetermined relationship thereto.

15. A pallet as defined in claim 13 wherein the flanges are of less length than that of the intervening arm, said flanges being normally coplanar with such arm and being adapted for bendability with respect thereto for accommodating various combined heights of the proximate stringer and deckboards.

16. For use with a pallet having spaced-apart stringers, a plurality of deckboards secured to upper and lower edges of said stringers in axial transverse relation thereto to define upper and lower decks, at least one end deckboard of each deck being spaced inwardly from the adjacent end of the stringers to form end spacings, the improvement comprising a protective device for disposition upon said at least one end of said pallet comprising a plurality of stringer end caps of generally U-shape cross-section having a pair of arms for extension between the upper and lower decks of the pallet and an interconnecting web, upper and lower rigid elongated members each of flat-sided tubular configuration and extending axially parallel to the lengthwise axis of said end caps and being fixed to the proximate upper and lower edges thereof for integration of the protective members, said elongated members lying within said end spacings in snug abutment against a proximate end face of a respective adjacent deckboard and against the adjacent edge of the stringers, said arms being of greater length than the transverse extent of said elongated members.

17. For use with a pallet having spaced-apart stringers, a plurality of deckboards secured to upper and lower edges of said stringers in axial transverse relation thereto to define upper and lower decks, at least one end deckboard of each deck being spaced inwardly from the adjacent end of the stringers to form end spacings, the improvement comprising a protective device for disposition upon said at least one end of said pallet comprising a plurality of stringer end caps of generally U-shape cross-section having a pair of arms for extension between the upper and lower decks of the pallet and an interconnecting web, upper and lower rigid elongated members extending axially parallel to the lengthwise axis of said end caps and being fixed to the proximate upper and lower edges thereof for integration of the protective members, said arms being of greater length than the transverse extent of said elongated members the webs interconnecting the arms of the end caps being of greater transverse extent than the pallet stringers, the related arms being of sufficient bendability about the line of jointure to the related web for flexure to compensate for the relative oversize character of such associated web.

18. The invention as defined in claim 16 wherein the protective member comprises first and second outer stringer end caps and a central or intermediate end cap, said outer stringer end caps having inner and outer arms of different height wherein the outer arms are of substantially greater height than the inner arms, and there being flanges provided at the upper and lower ends of each outer arm.

19. The invention as defined in claim 18 wherein such flanges are normally in planar perpendicular relationship to the intervening arm and are of substantially like lengthwise extent therewith.

20. The invention as defined in claim 18 wherein the flanges are normally in coplanar relationship with the intervening portion of the related arms and are adapted for bendability with respect to the line of jointure therebetween, said flanges being of less lengthwise extent than the associated arm.

21. A pallet comprising a plurality of deckboards defining a loading deck having first and second opposite ends and first and second opposite sides, elevating means provided beneath and secured to said deckboards for maintaining same in upwardly spaced relation to a support surface, said elevating means projecting beyond said first and second pallet opposite ends, said elevating means comprising a plurality of central blocks located intermediate adjacent outer blocks, a protective member provided at each of said first and second ends of said pallet shieldingly accepting said projecting portion of said elevating means, said protective member having portions extending beneath said deck and means securing said last mentioned portions of said protective member to said elevating means beneath said deck, said protective member having cap-forming portions for shieldingly accepting the adjacent blocks, each cap having parallel side walls and an interconnecting web, there being upper and lower elongated members of flat-sided tubular configuration provided on said protective member for abutment against said elevating means in the portions thereof projecting beyond said first and second pallet opposite ends.

22. A pallet as defined in claim 21 wherein a second protective member is provided at each of said first and second opposite sides of said pallet.

23. A pallet as defined in claim 21 wherein first flange-forming members are provided on said protective member for disposition above said deck and fastening means for interengaging said flange-forming members to the adjacent deckboards.

24. A pallet as defined in claim 23 wherein second flange-forming members are provided on said protective member in opposed relationship to said flange-forming members, and means interengaging said second flange-forming members with said elevating means.

25. The pallet defined in claim 21 wherein a second protective member is provided on each of said pallet first and second opposite sides, said second protective member having a cap with opposed parallel sides and a connecting web for embracing the proximate center block.

* * * * *